US005871272A

United States Patent [19]

Sharrah et al.

[11] Patent Number: 5,871,272

[45] Date of Patent: Feb. 16, 1999

[54] FLASHLIGHT WITH ROTATABLE LAMP HEAD

[75] Inventors: Raymond Sharrah, Collegeville; John DiNenna, Bridgeport; Charles Craft, Lansdale, all of Pa.

[73] Assignee: Streamlight, Incorporated, Norristown, Pa.

[21] Appl. No.: 789,916

[22] Filed: Jan. 28, 1997

[51] Int. Cl.[6] ..... F21L 7/00

[52] U.S. Cl. ..... 362/184; 362/197; 362/228; 362/231; 362/243; 362/800

[58] Field of Search ..... 362/62, 184, 185, 362/197, 228, 243, 800, 199, 231

[56] References Cited

U.S. PATENT DOCUMENTS 4,963,798 10/1990 McDermott ..... 315/312

5,081,568 1/1992 Dong et al. ..... 362/184

5,359,779 11/1994 Polk et al. ..... 33/241

*Primary Examiner*—Stephen F. Husar

*Attorney, Agent, or Firm*—Dann, Dorfman, Herrell & Skillman, P.C.

[57] ABSTRACT

A flashlight with a rotatable lamp head is provided. The lamp head pivots about two cylindrical coaxial electrical connectors. The lamp head also includes a reflector having a major parabolic reflective surface and a minor reflective parabolic surface. The reflector is configured so that the minor reflective surface is nested within the major reflective surface. The flashlight also includes a series of fluid-tight seals to insure that the flashlight is waterproof. In addition, a flapper valve is provided to function as a one-way valve allowing the release of gases produced by use of the batteries, and preventing fluid from entering the flashlight. A battery charger is also provided to recharge a battery pack for the flashlight.

3 Claims, 12 Drawing Sheets

FLASHLIGHT WITH ROTATABLE LAMP HEAD

FIELD OF THE INVENTION

The present invention relates to battery-powered flashlights. In particular, the present invention relates to battery-powered flashlights having a rotatable lamp head incorporating multiple lamp elements.

BACKGROUND OF THE INVENTION

Battery-powered flashlights are well known in the art. Many of the known devices incorporate features directed to such problems as hands-free operation and underwater applications. However, the flashlights that incorporate such features typically involved complex electrical and mechanical connections that complicate the manufacture and assembly of such flashlights. The complex configurations tend to reduce the reliability of such flashlights, while increasing the cost of the flashlights to the consumers.

SUMMARY OF THE INVENTION

In accordance with the present invention, a flashlight is provided having a lamp head connected to a housing in which batteries are located. The lamp head includes first and second reflective surfaces from which two light elements project. An incandescent light bulb projects from the first reflective surface, and a light-emitting diode projects from the second reflective surface. A conductive element provides an electrical path connecting the battery to the light bulb and the light-emitting diode.

BRIEF DESCRIPTION OF THE DRAWINGS

All of the objects of the present invention are more fully set forth hereinafter with reference to the accompanying drawings, wherein.

DETAILED DESCRIPTION

Figure 1:
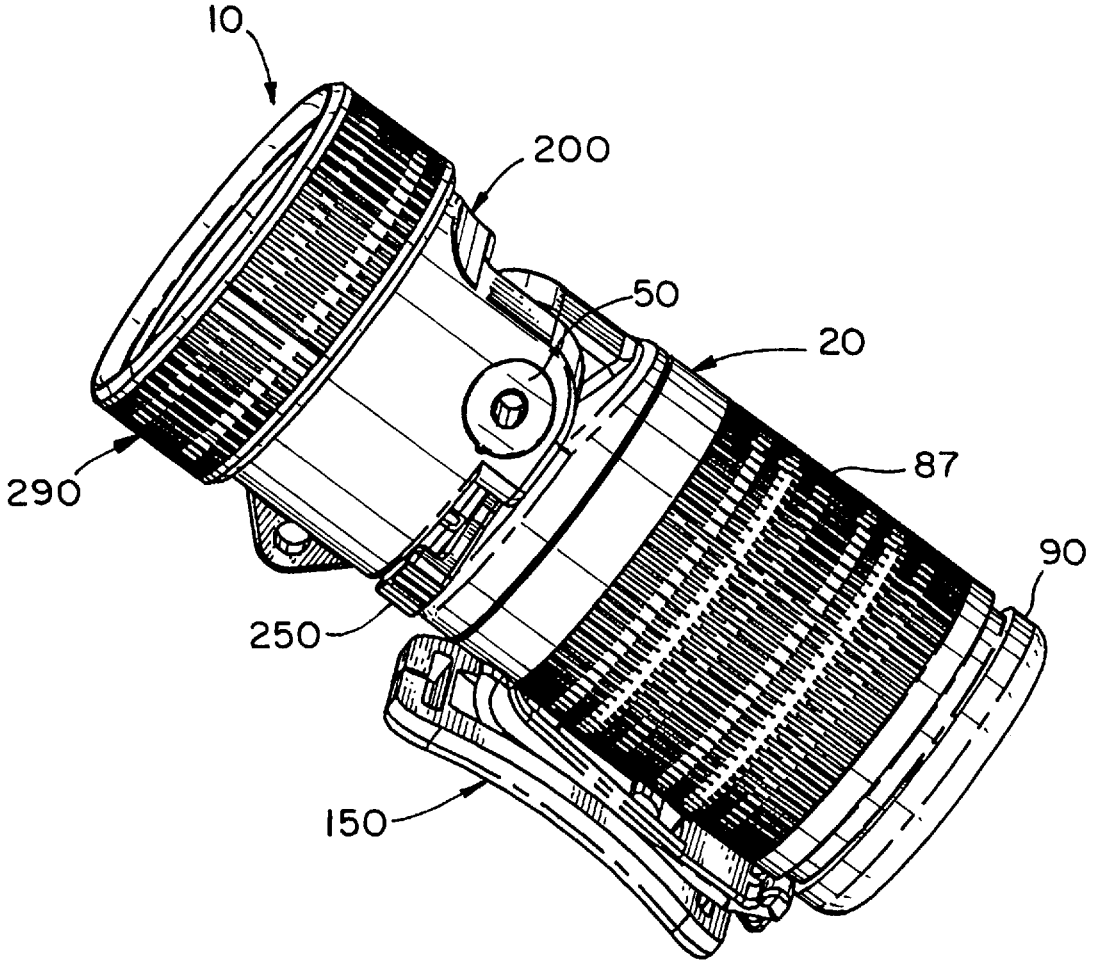
FIG. 1 is a perspective view of a flashlight embodying aspects of the present invention.
Figure 2:
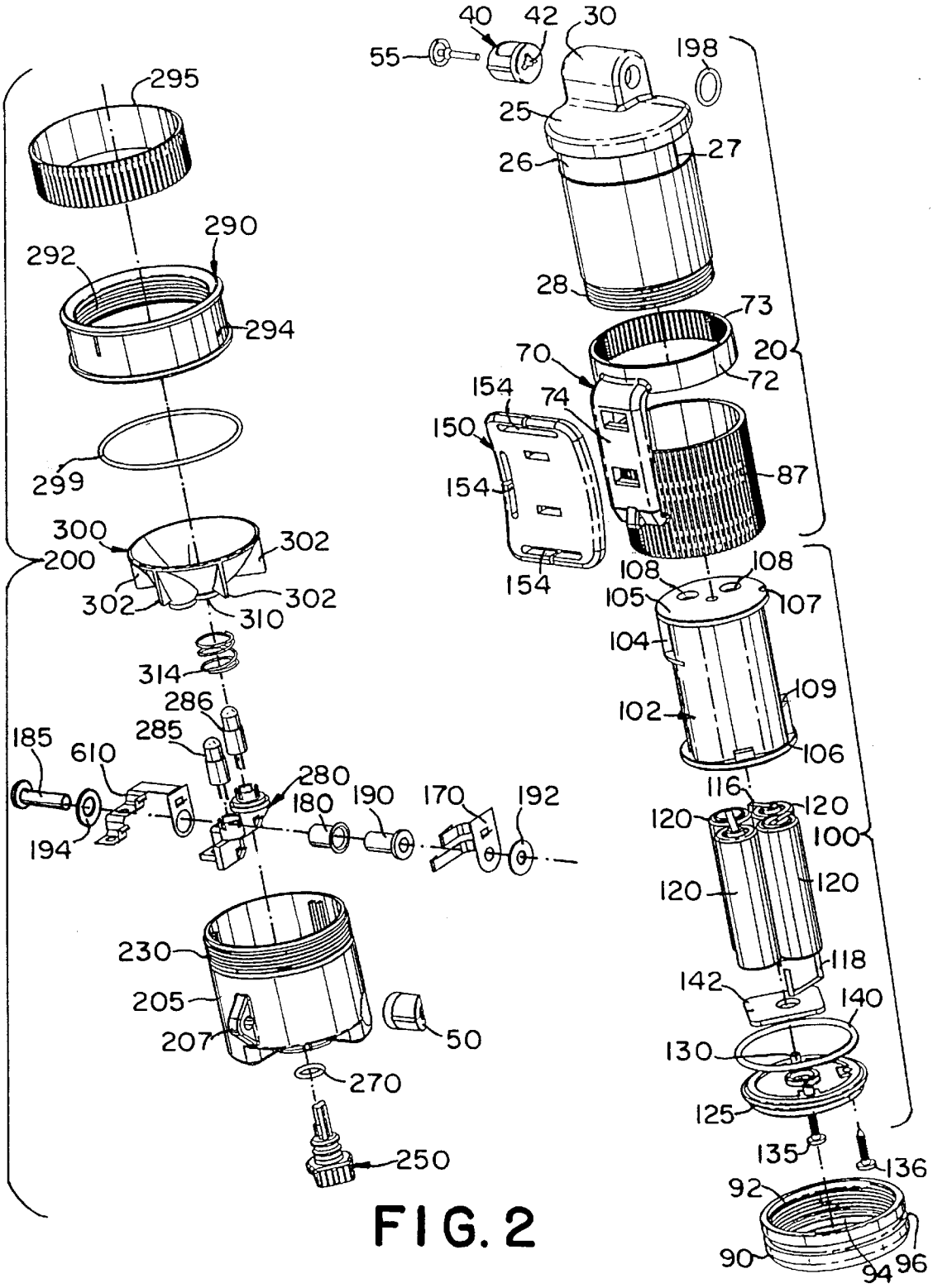
FIG. 2 is an exploded perspective view of the flashlight shown in FIG. 1.
Figure 5:
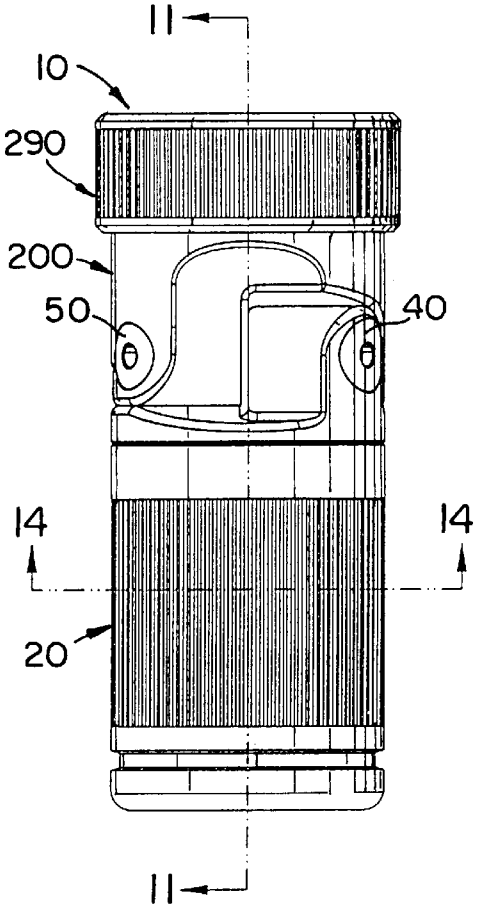
FIG. 5 is a rear elevational view of the flashlight shown in FIG. 1.
Figure 4:
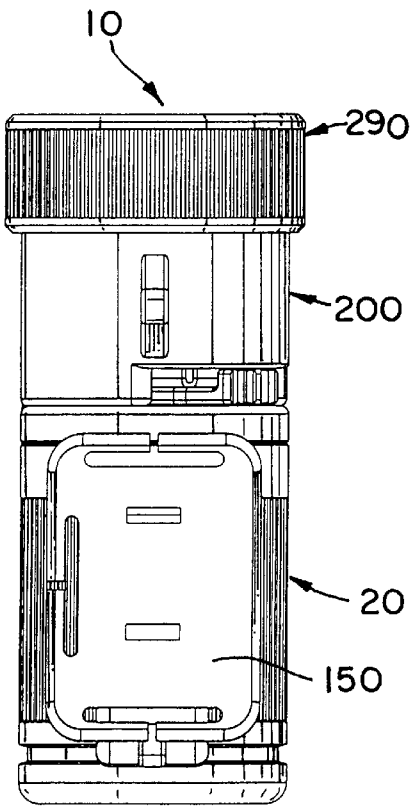
FIG. 4 is a front elevation view of the flashlight shown in FIG. 1.
Figure 3:
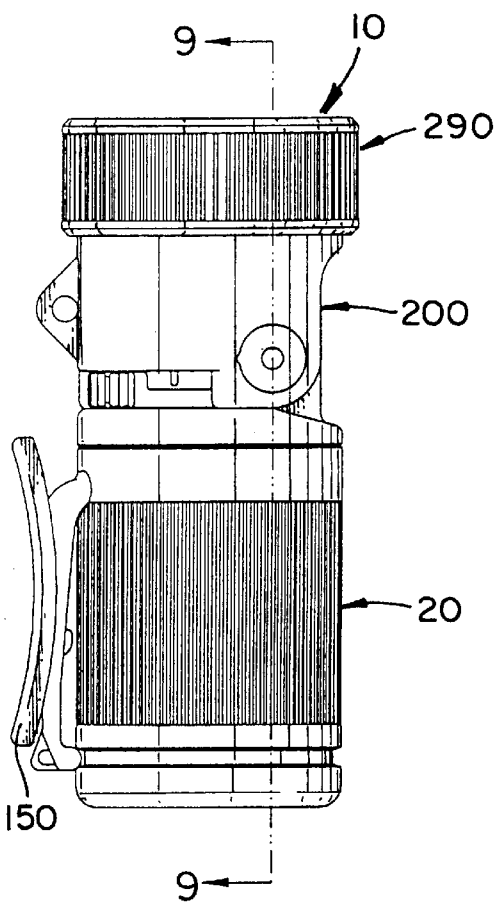
FIG. 3 is a side elevational view of the flashlight shown in FIG. 1.
Figure 6:
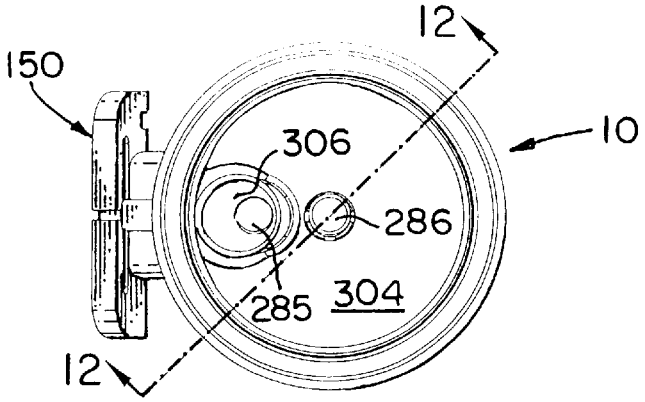
FIG. 6 is a top plan view of the flashlight shown in FIG. 1.
Figure 7:
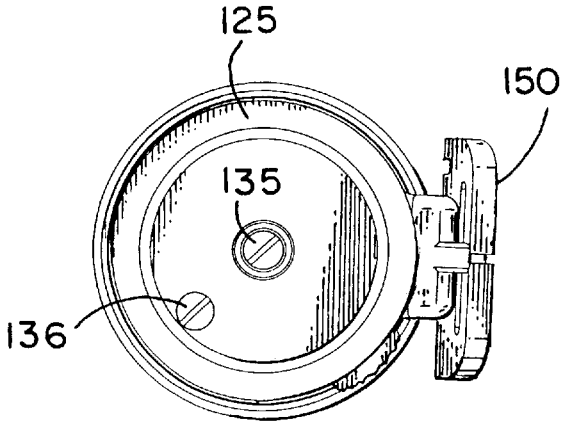
FIG. 7 is a bottom plan view of the flashlight shown in FIG. 1.

Referring now to the drawings and in particular to FIGS. 1 and 2, a multi-function flashlight 10 according to the present invention is shown. The flashlight 10 includes a lamp head 200 pivotally mounted to a body 20. A ring clip 70 connected to the body 20 allows the flashlight 10 to be clipped onto a pocket or a belt. In addition, a saddle 150 mounts onto the ring clip 70 so that the light can be worn on the users head, or mounted on a helmet. The lamp head 200 includes a dual-parabolic-surface reflector 300.

The general interconnection of the various components of the flashlight is shown more clearly in FIG. 2. The body 20 is a generally cylindrical shell having a threaded open end for receiving a battery pack 100. The battery pack 100 includes one or moe batteries disposed in a battery casing 102. The embodiment shown in FIG. 2 includes four serially interconnected batteries 120. A locking collar 90 threads onto the open end of the body 20 to secure the battery pack 100 in the body.

A mounting stem 30 on the end of the body 20 is formed for making a pivotable connection with and for mating engagement with a recess 237 formed in the lamp head 200. A metallic pivot pin 180 extends through an opening in mounting stem 30 and a coaxial opening in the lamp head 200 to provide an electrical path between the body 20 and the lamp head 200. A lamp socket 280 is mounted within the lamp head housing 205 for receiving two lamp elements 285,286. Although both lamp elements can be incandescent bulbs, preferably lamp element 286 is an incandescent bulb, and lamp element 285 is a light-emitting diode (LED). Preferably, the LED lamp element 285 has a lower light intensity than the incandescent lamp element 286 so that the LED lamp element is operable to provide low level light intensity when such is desired. In addition, preferably the LED emits a non-white light such as red or green. A non-white LED allows the flashlight to be used in certain situations without significantly impairing the night vision of the operator.

The dual-parabolic-surface reflector 300 is mounted in the housing 205 so that the lamp elements 285,286 project through two openings found in the reflector. As is discussed further below, the reflector 300 has two parabolic reflecting surfaces: a minor concave reflective surface 306 nested within a major concave reflective surface 304. In the embodiment shown, the incandescent lamp element 286 projects through the center of the major parabolic reflective surface, and the LED lamp element 285 projects from the center of the minor parabolic reflective surface.

A focusing ring 290 having internal threads 292 that engage with external threads 230 on the end of the lamp head housing 205 retains the reflector 300 within the housing. A coil spring 314 disposed between the lamp socket 280 and reflector 300 in coaxial relationship with the incandescent lamp element 286 biases the reflector away from the lamp socket so that the reflector is urged into contact with the focusing ring 290. In this way, rotation of the focusing ring 290 displaces the reflector 300 relative to the lamp elements 285,286. A gripping ring 295 is mounted in a circumferential groove 294 formed on the external surface of the focusing ring 290.

Figure 10:
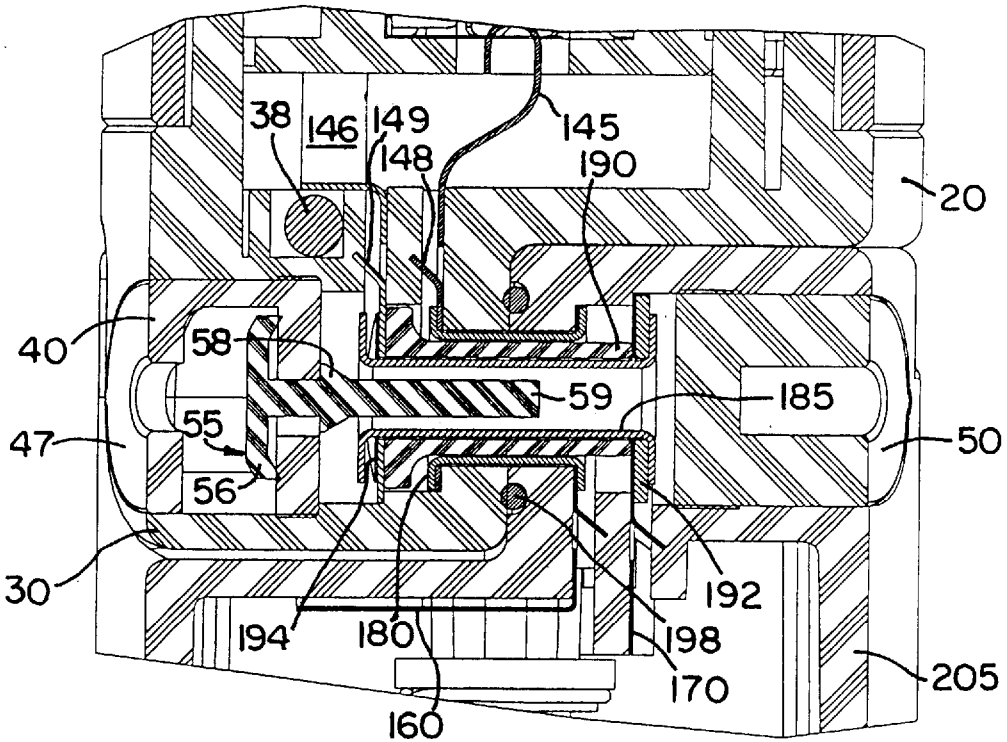
FIG. 10 is an enlarged fragmentary view of a portion of the flashlight shown in FIG. 9 bounded by circle 10.
Figure 9:
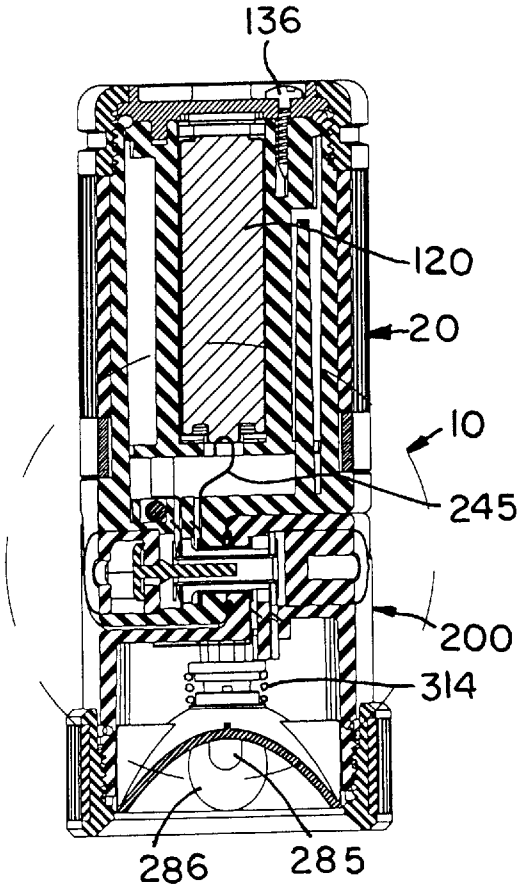
FIG. 9 is a cross-sectional view of the device shown in FIG. 3 taken along the line 9—9.

Electrical energy is provided to the lamp elements 285, 286 from the battery back 100 via a series of conductive contacts. Referring now to FIGS. 9 and 10, a positive battery conductor 145 connects a positive terminal of the battery pack 100 to the metallic pivot pin 180. The pivot pin is connected to a lamp contact 160 against which one prong of each of the lamp elements 285,286 is maintained. A switch contact 170 is connected to a cylindrical conductive shell 185 that is coaxial with and located within the metallic pivot pin 180. The conductive shell 185 is connected with a negative battery contact 146 of the battery pack 100.

Referring back to FIG. 2, the circuit between the battery pack 100 and the lamp elements is controlled by the switch 250, which has three operative positions. A switch contact 170 selectively contacts one or none of the second prongs of lamp elements 285,286 as switch 250 is moved to its various positions. In the first position, a switch contact 170 contacts the second prong of the first lamp element 285 to close the electrical circuit, so that the first lamp element is illuminated. In the second or off position, the switch contact 170 contacts neither of the lamp elements. In the third position, the switch contact 170 contacts the second prong of the second lamp element 286, so that the second lamp element is illuminated.

Flashlight Body

Figure 12:
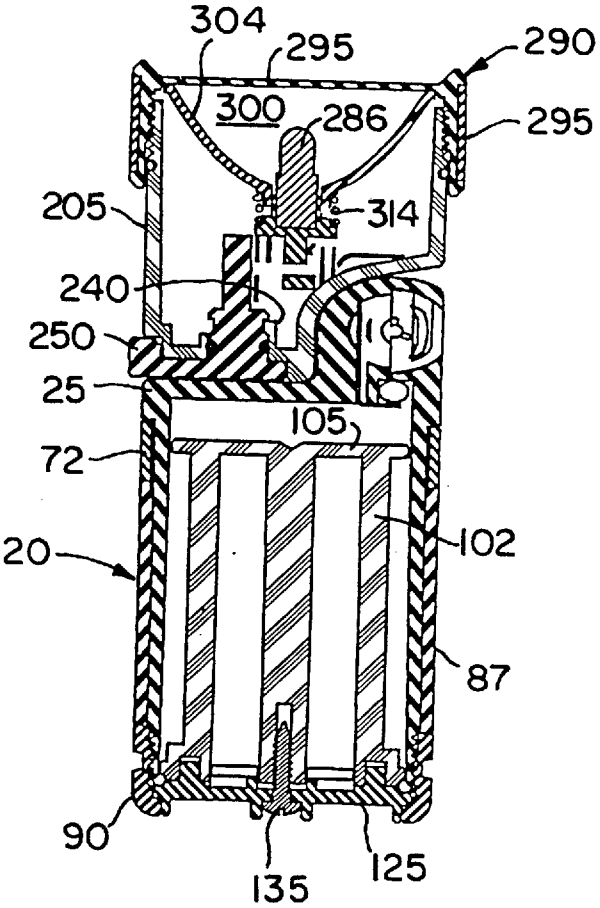
FIG. 12 is a cross-sectional view of the flashlight shown in FIG. 6 taken along line 12—12.
Figure 11:
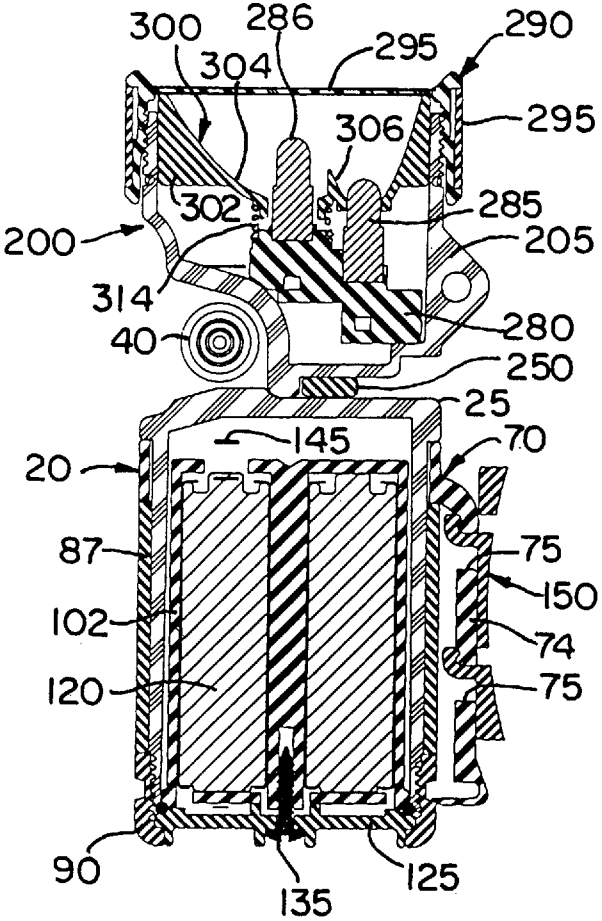
FIG. 11 is a cross-sectional view of the flashlight shown in FIG. 5 taken along line 11—11.
Figure 14:
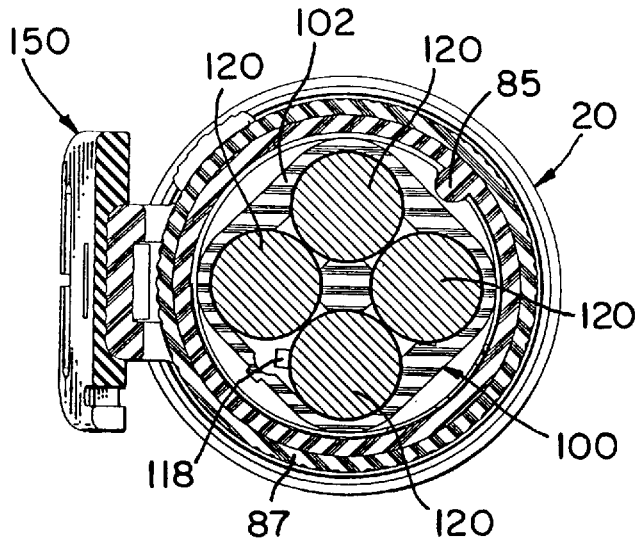
FIG. 14 is a cross-sectional view of the flashlight shown in FIG. 5 taken along line 14—14.

Referring now to FIGS. 2, 11 and 12, the details of the flashlight body 20 are shown more clearly. The flashlight body 20 has a hollow interior. The flashlight body 20 has end cap 25 that is preferably formed integrally with the sidewall of the flashlight body. The distal or open end of the flashlight body has external threads 28 formed thereon. A locking ring 90 has internal threads 92 formed therein for mating engagement with the external threads 28.

Adjacent the end cap 25, the flashlight body has circumferential groove 26 formed thereon for receiving the clip ring 70. The groove 26 includes at least one detent 27 extending across the width of the groove which cooperates with ridges in the clip rings 70 as is discussed further below. The clip ring 70 includes a ring portion 72 that is dimensioned to fit within the groove 26. A clip arm 74 extends from the ring portion 72. The internal surface of ring 72 includes a plurality of parallel grooves 73 that engage with the detent 27 in the groove 26. The engagement of a groove 73 with detent 27 prevents the ring portion 72 from easily rotating relative to the flashlight body. When sufficient force is applied to disengage the groove 73 from detent 27, the clip ring 70 can be rotated to a desired position.

The clip arm 74 includes a pair of sockets 75 to facilitate the attachment of a mounting saddle 150. The mounting saddle 150 is a removable device that allows the flashlight to be affixed upon a curved surface such as a helmet or an operator's head. As shown in FIG. 11, the saddle 150 includes a pair of saddle clips 156 having curved gripping ends. The saddle 150 is attached to the clip arm 74 by inserting the saddle clips 156 into the sockets so that the gripping ends of the saddle connectors engage the inside surface of the clip arm. The flashlight 10 is then mounted on a helmet. Once mounted on a helmet, the operator can direct a beam of light in a desired direction by turning and/or tilting his head. The saddle is attached to the operator's head or helmet by one or more straps. As shown in FIG. 2, the saddle 150 includes a plurality of strap slots 154 for that purpose. Straps are threaded through the strap slots and then wrapped around the operator's head or his helmet. The saddle 150 can also be affixed to a helmet with double-sided adhesive tape.

Preferably, the flashlight body 20 includes a grip sleeve around the outer surface of the body below the ring clip 70. In the preferred embodiment, the gripping sleeve is made of an elastomeric material and has a plurality of parallel ridges to facilitate gripping the flashlight. However, the gripping sleeve can also have a smooth surface.

Figure 18:
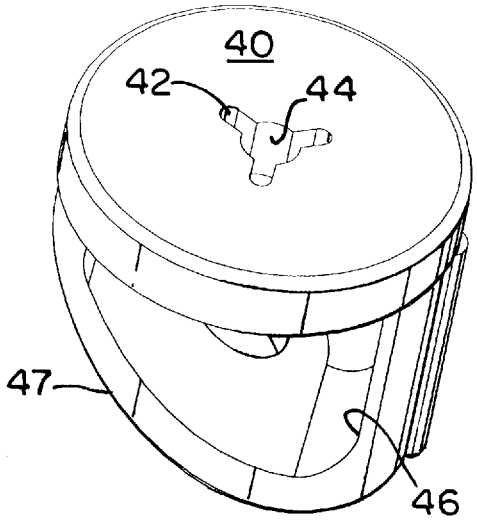
FIG. 18 is an enlarged perspective view of a vent plug incorporated into the flashlight shown in FIG. 1.

Referring now to FIG. 10, the end cap 25 of the flashlight body 20 includes an integral mounting stem 30 that is hollow. The mounting stem 30 has a stepped through-bore for receiving a hollow vent plug 40. As seen in FIG. 18, the hollow vent plug includes a trilobal bore 42 through an inner wall thereof. The trilobal bore has a central bore 44 connecting three slots 42 extending through the inner wall of the hollow vent plug and directed radially relative to the central bore 44. Vent plug 40 also has an external wall 47 that is contoured to maintain the curvature of the surface of stem 30.

A flapper valve 55 is disposed in the central bore 44 of the vent plug 40 and extends through the inner wall of vent plug 40. The hollow vent plug 40 has an open side 46 to facilitate insertion of the flapper valve 55. The vent plug is press-fit into the stepped bore of the mounting stem so that the vent plug abuts a shoulder in the stepped bore. The flapper valve 55 includes an enlarged head 56 that engages the inner surface of the vent plug to form a seal over the trilobal bore 42. The flapper valve 55 includes a stem 59 connected to the enlarged head, which passes through the central bore of the vent plug 40. An integral barb 58 on the stem 59 is formed on the outer surface of the stem 59 to fix the flapper valve in place on the vent plug. Two passageways extend through the end cap 25 so that the inside of the flashlight body communicates with the stepped bore of the mounting stem 30. Gases produced by use of the batteries pass through those passageways and then through the trilobal bore in the vent plug 40. When the gas pressure reaches a threshold level, the head 56 displaces and the gases are vented from the flashlight. In this manner, the flapper valve functions as a one-way valve that allows the release of gases produced from use of the batteries, while preventing fluid from entering the flashlight.

Each of the passageways between the body and the mounting stem are configured to receive one of the two battery contacts 145 or 146. As shown in FIG. 10, the battery contacts 145 and 146 are fixed in place in the passageway by barbs 148 and 149 on the respective contacts. Prior to inserting the battery contacts 145 and 146 into the passageway, a deoxidizing pellet 38 is placed in a recess in end cap 25. When inserted in its passageway, the negative battery contact 146 is positioned to maintain the deoxidizing pellet in the recess.

Battery Pack

Referring again to FIGS. 2, 9, 11 and 12, the battery pack 100 includes a case 102 having a closed end 105 and an open end for receiving one or more batteries 120. When assembled, the open end is sealed by an O-ring 130 and an end cap 125 that is removably connected to the casing by two screws 135,136 that extend through the end cap and into the body of case 102. The batteries 120 can be either disposable or rechargeable. In the preferred embodiment, the batteries 120 are rechargeable batteries that are serially connected to one another by a plurality of battery connector straps 118. One of the battery straps is connected to a thermal fuse and a diode, which are not shown, and is engaged by the central screw 135 that attaches the end cap 125 to the housing 102. A second battery connector strap is engaged by the side screw 136 that connects the end cap 125 to the casing 102. The battery strap that engages the center screw 135 is separated from the battery strap that engages the side screw 136 by an insulator 142. The center screw 135 and the side screw 136 are electrically connected to the batteries 120 and act as terminals for recharging the battery 100.

The closed end 105 of the case 102 has an annular flange that is slightly smaller than the inner diameter of the flashlight housing 20. Two holes 108 in the closed end 105 provide access ports for the battery contacts 145 and 146 to contact the respective positive and negative terminals of the battery pack. A recess 107 in the edge of the closed end 105 cooperates with an axially elongated alignment rib 85 projecting from the inner surface of the flashlight body 20. The alignment rib 85 acts as a key to align the battery pack 100 to ensure that the battery pack is properly oriented within the flashlight housing. The casing 102 further includes an external rib 104 that cooperates with a latch in a recharger 400 used to recharge the battery pack as described below.

The battery pack 100 is secured within the flashlight housing 20 by a locking ring 90 having internal threads that engage with the external threads 28 of the flashlight body. The locking ring urges the end cap 125 of the battery pack 100 against O-ring 130 that engages the end of the flashlight body to provide a fluid-tight seal.

The Lamp Housing

Figure 8:
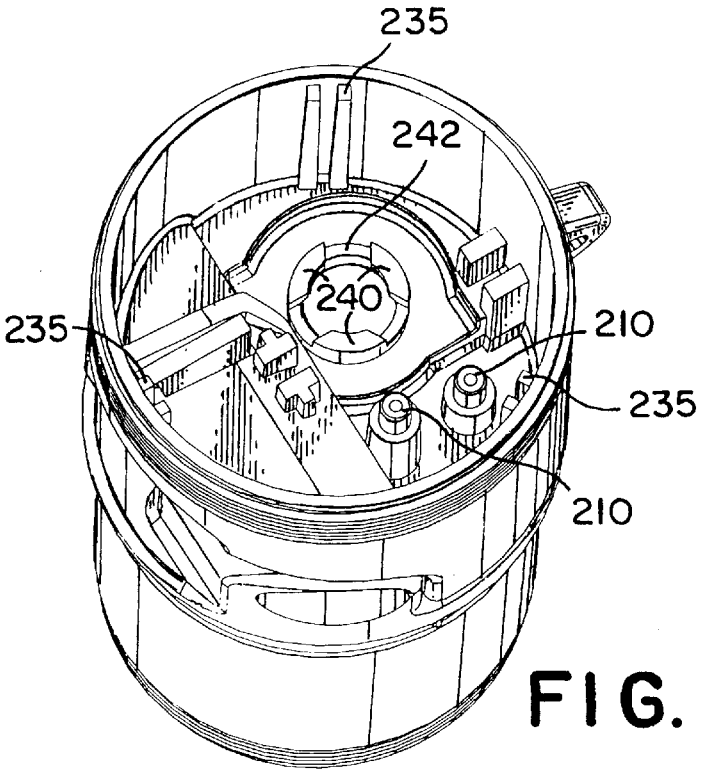
FIG. 8 is a perspective view of the flashlight shown in FIG. 1 with components removed to show the configuration of the inside of the lamp housing.

Referring now to FIGS. 2, 8 and 9, the details of the lamp head 200 are seen more clearly. The lamp head includes a housing 205 that is pivotally connected to the mounting stem 30 of the flashlight body 20. The housing 205 includes a pair of mounting posts 210 onto which the lamp socket 280 and the lamp contact 160 are mounted. The posts 210 project through holes formed in the lamp socket and the lamp contact respectively. The posts are flared by applying heat and pressure to the ends thereof to retain the lamp socket 280 and the lamp contact 160 in place. The lamp housing 205 further includes an aperture 242 through which the switch 250 projects. Arcuately spaced pairs of parallel ribs 235 are disposed around the inner circumference of lamp housing 205 to serve as guides for mounting the reflector 300 and positioning relative to the lamp elements 285 and 286.

The electrical and mechanical interconnection between the flashlight body 20 and the lamp head 200 is shown more clearly in FIG. 10. The first mechanical and electrical connection between the lamp head 200 and the flashlight housing 20 is provided by a hollow metallic pin 180. The hollow pin 180 has a flanged head at one end thereof. The hollow pin 180 extends through the stepped bore in the mounting step 30 of the body, through a hole in the positive battery contact 145, through an aperture in the lamp head housing, and finally through an aperture in the lamp contact 160. The flanged head of hollow pin 180 abuts the wall of stem 30 surrounding the stepped bore to prevent the hollow pin from sliding therethrough. The other end of the hollow steel pin 180 is crimped over onto the lamp contact 160 to fix the pin in place. In this way, the hollow pin 180 provides a pivotal connection between the lamp head 200 and the flashlight body 20, as well as an electrical connection from the positive battery contact 145 to the lamp contact 160. An O-ring 198 disposed between the lamp head 200 and the mounting stem 30 provides a fluid-tight seal between the lamp head and the flashlight body 20.

A spacer sleeve 190, which may be formed of an electrically insulating material, is disposed coaxially through the hollow pin 180. Spacer sleeve 190 has a flange formed at one end thereof. A second hollow metallic pin 185 extends coaxially through the spacer 190. The pin 185 extends through an aperture in the negative battery contact 146 and a spring washer 194. The inner pin 185 has a flanged head that engages a conductive washer 192 which contacts the switch contact 170. To fix the inner pin 185 in place, the non-flanged end thereof is crimped against the flanged head of the spacer 190. The insulator spacer 190 supports the crimping forces that are applied to the inner pin 185 so that the crimping forces are not transferred to the outer pin 180, which could adversely affect the interconnection between the lamp head 200 and the flashlight body 20. The washer 192 provides an increased surface area to distribute the reaction forces associated with the crimping of the inner pin 185 against the flanged head of the insulator sleeve 190. The inner hollow pin 185 provides an electrical connection between the switch contact 170 and the negative battery contact 146. A sealing plug 50 is disposed in a recess in the side of the lamp housing 205. The recess provides an access port for inserting and crimping the inner and outer hollow pins 180 and 185.

Figure 15:
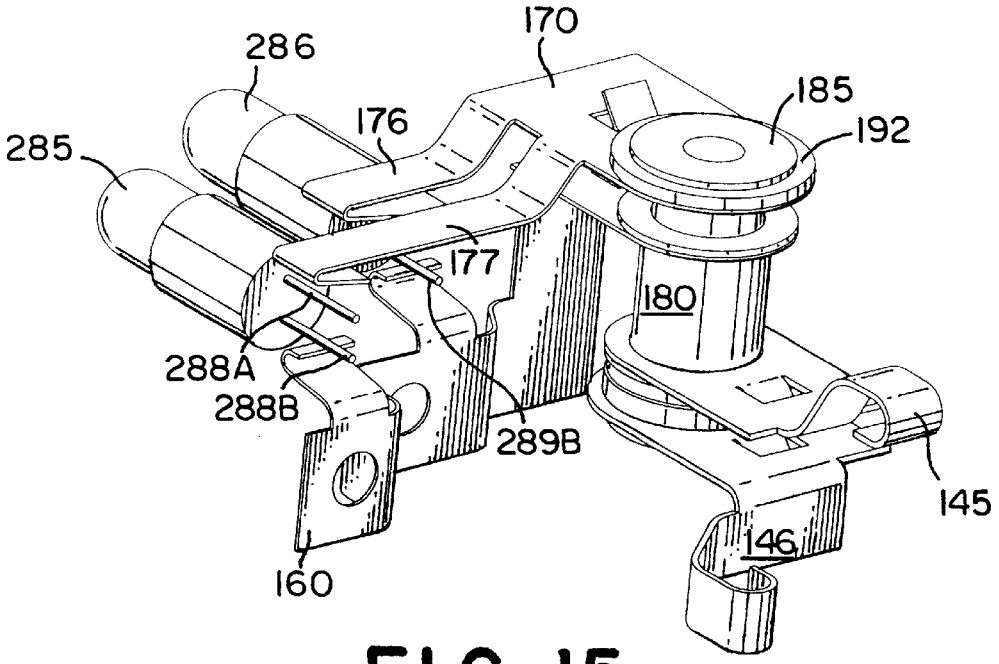
FIG. 15 is an enlarged perspective view of conductive elements and lamp elements incorporated into the flashlight shown in FIG. 1.
Figure 16:
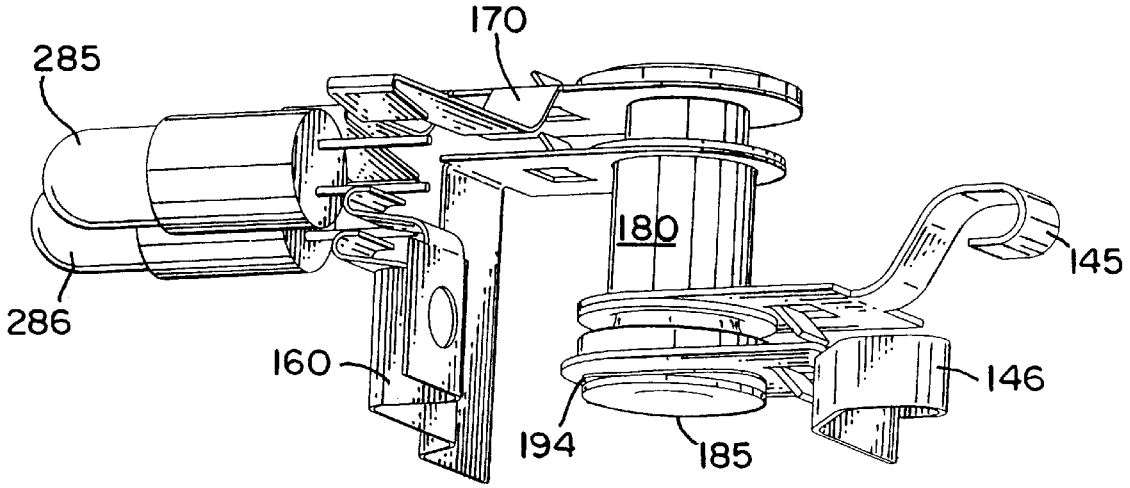
FIG. 16 is a second enlarged perspective view of the conductive elements and lamp elements illustrated in FIG. 15.

The lamp head 200 includes two lamp elements 285 and 286 that are mounted in the lamp socket 280. Referring now to FIGS. 15 and 16, each lamp element 285,286 includes two prongs 288*a*,288*b*, and 289*a*,289*b*, respectively. The lower prongs 288*b*,289*b* of the lamp elements contact the lamp contact 160. The upper prongs 288*a*,289*a* are normally spaced from two resilient arms 176 and 177 of the switch contact 170. The arms 176 and 177 are resilient and cooperate with the switch 250.

Figure 17:
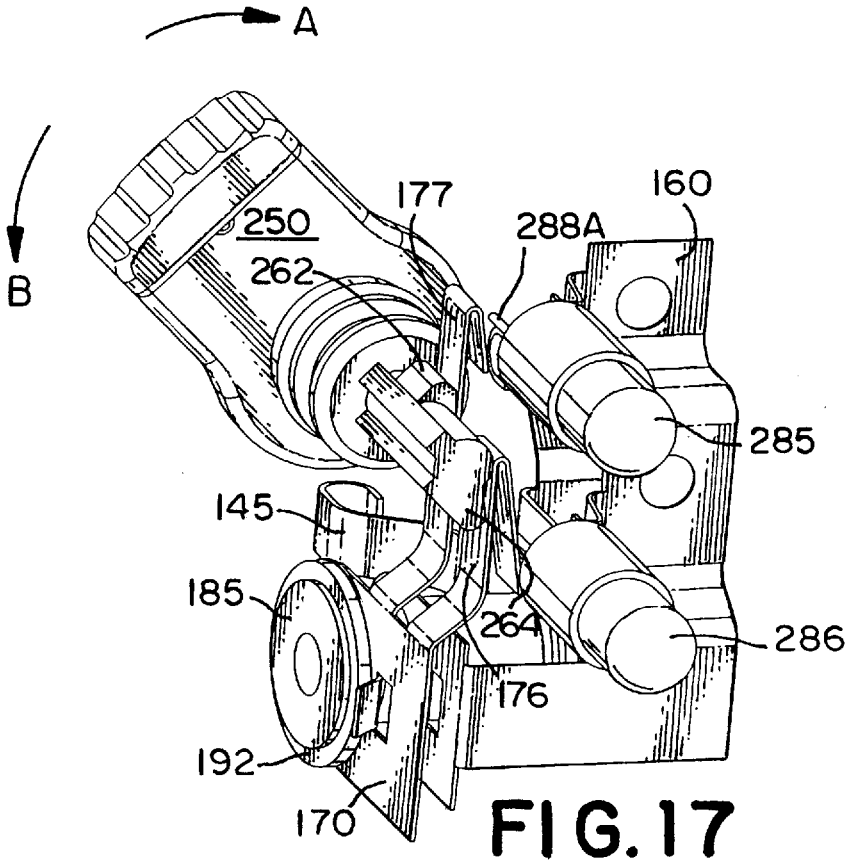
FIG. 17 is a third enlarged perspective view of the conductive elements and lamp elements shown in FIG. 15, illustrated in combination with a switch.

The switch 250 includes a rotatable shaft having two eccentric lobes 262 and 264. As noted previously, the switch 250 operates in three positions. As shown in FIG. 17, the second or off position is illustrated. In the off position, the eccentric lobes 262,264 do not urge either of the switch contact arms 176,177 into contact with the lamp element prongs. Rotating the switch 250 in the direction of arrow A causes the eccentric lobe 262 to engage the second contact arm 177 and force it into contact with prong 288*a* of lamp element 285. At the same time, eccentric lobe 264 is rotated away from the second switch contact arm 176 so that the second contact arm does not contact prong 289*a* of lamp element 286. When switch 250 is rotated in the direction of arrow B, eccentric lobe 264 forces the first contact arm 176 into contact with the second prong 289*a* of lamp element 286. In this way, the switch operates to control the illumination of lamp elements 285 and 286 independently of one another.

Referring now to FIGS. 8 and 12, the switch 250 is mounted in the aperture 242 in the base of the lamp housing 205. A plurality of resilient switch-holding fingers 240 engage an annular groove in the switch to retain the switch in the lamp housing. In addition, an O-ring is disposed between the switch 250 and the lamp housing 205 to provide a fluid-tight seal between the switch and the lamp housing.

Figure 13:
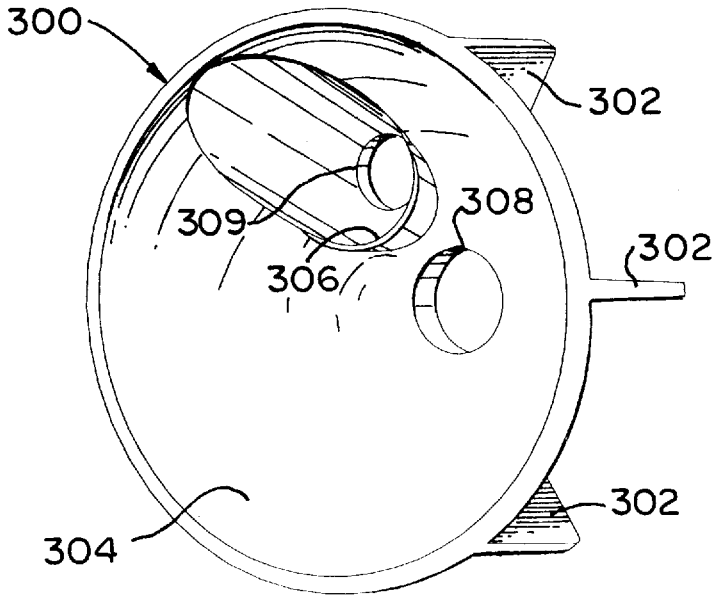
FIG. 13 is a perspective view of a reflector incorporated in the flashlight shown in FIG. 1.

Referring to FIGS. 11 and 13, the reflector 300 has a pair of apertures 308 and 309 formed therein for receiving the light elements 285 and 286. The lamp elements 285 and 286 project through the apertures 308 and 309 as described hereinabove. The reflector includes two parabolic reflecting surfaces. The first is a major parabolic reflective surface generally symmetric about an axis through the central aperture 308. Nested within a sector of the major parabolic surface is a second minor parabolic reflecting surface 306 that is generally symmetric about an axis through the aperture 309. In this way, the reflector 300 incorporates a smaller reflective surface 306 nested within a larger reflective surface 304. The major parabolic reflective surface 304 provides a reflective surface for the central lamp element 286 and the minor parabolic reflective surface 306 provides a reflective surface for the second lamp element 285. Because of this unique configuration, the minor reflective surface 306 does not substantially interfere with the reflection of the light from lamp element 286 off of the major reflective surface 304.

An O-ring 299 is disposed between the lamp housing 205 and the focusing ring 290 to provide a fluid-tight seal between the focusing ring and the lamp housing. In addition, as shown in FIGS. 11 and 12, the focusing ring 290 includes an integral lens 298.

Battery Charger

Figure 19:
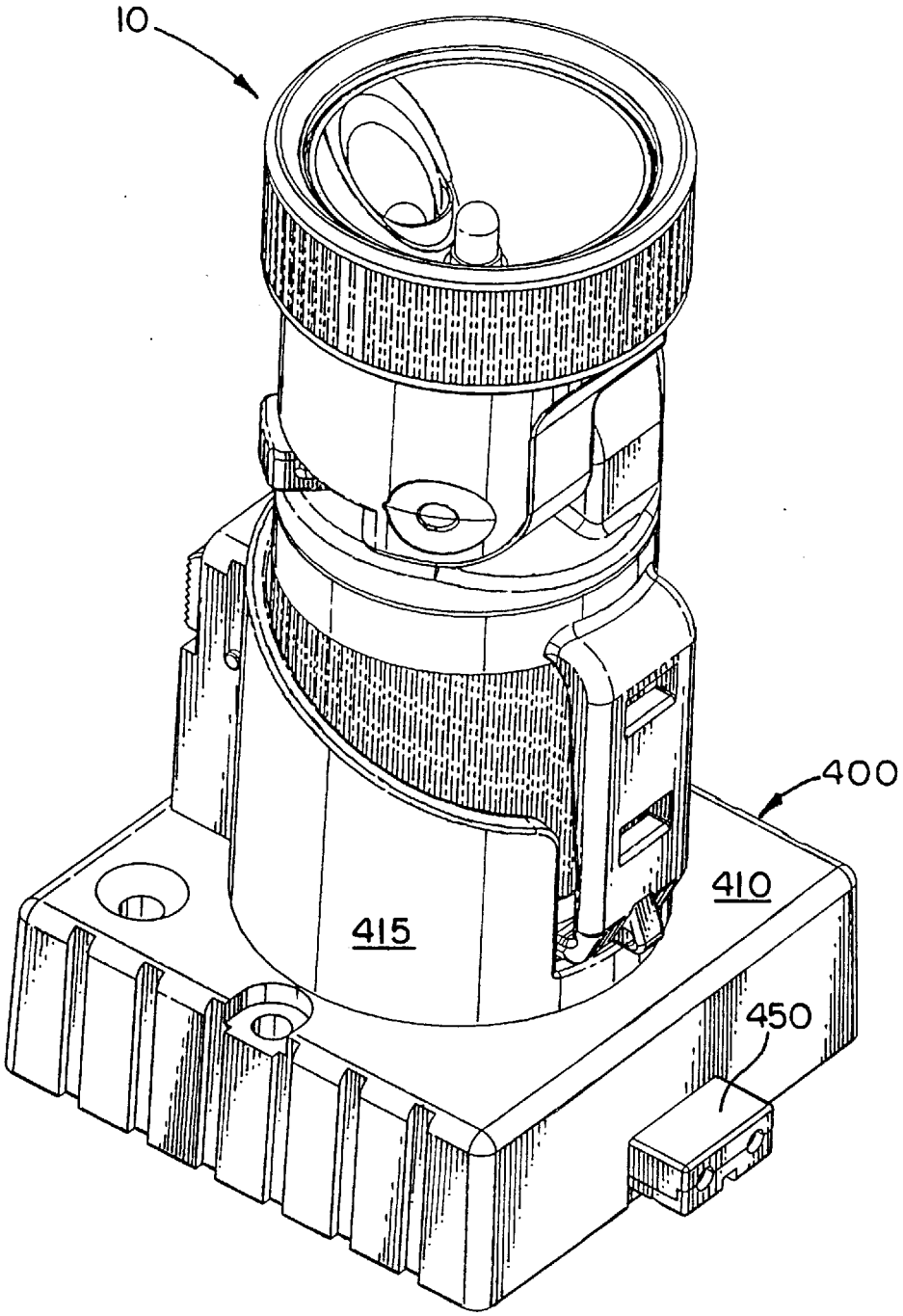
FIG. 19 is a perspective view of a flashlight mounted in a battery charger embodying aspects of the present invention.
Figure 20:
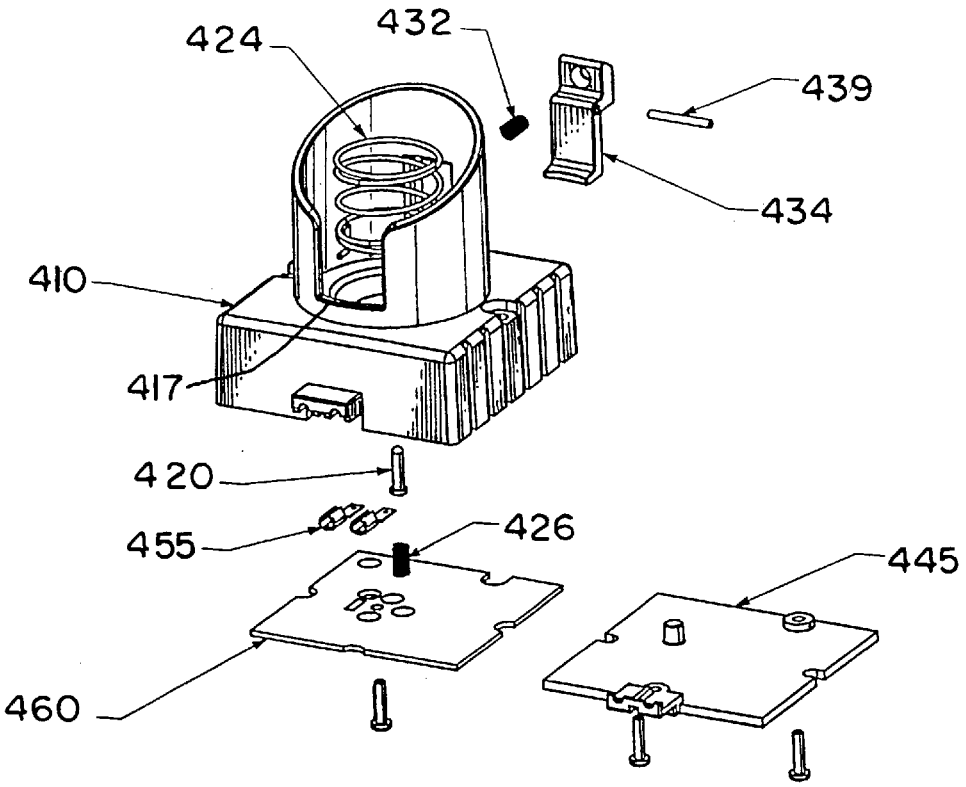
FIG. 20 is an exploded perspective view of the battery charger shown in FIG. 19.
Figure 21:
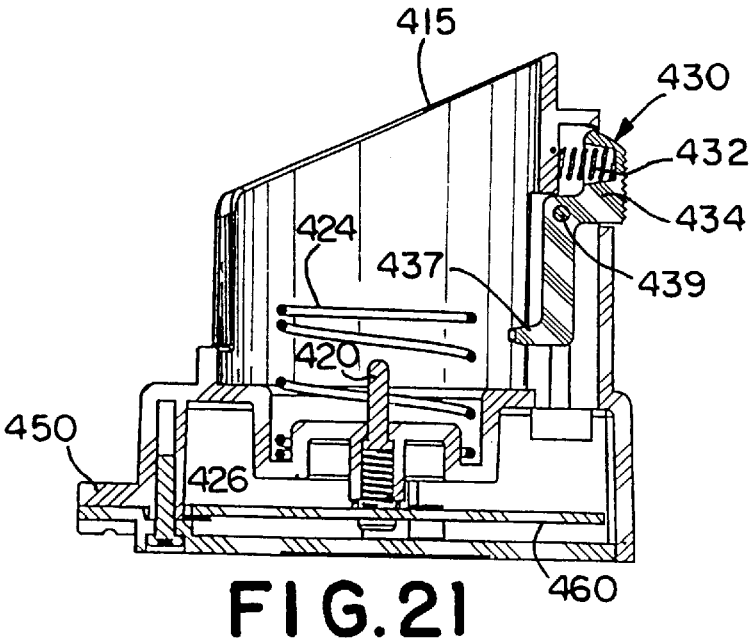
FIG. 21 is an enlarged cross-sectional view of the charger shown in FIG. 20.
Figure 22:
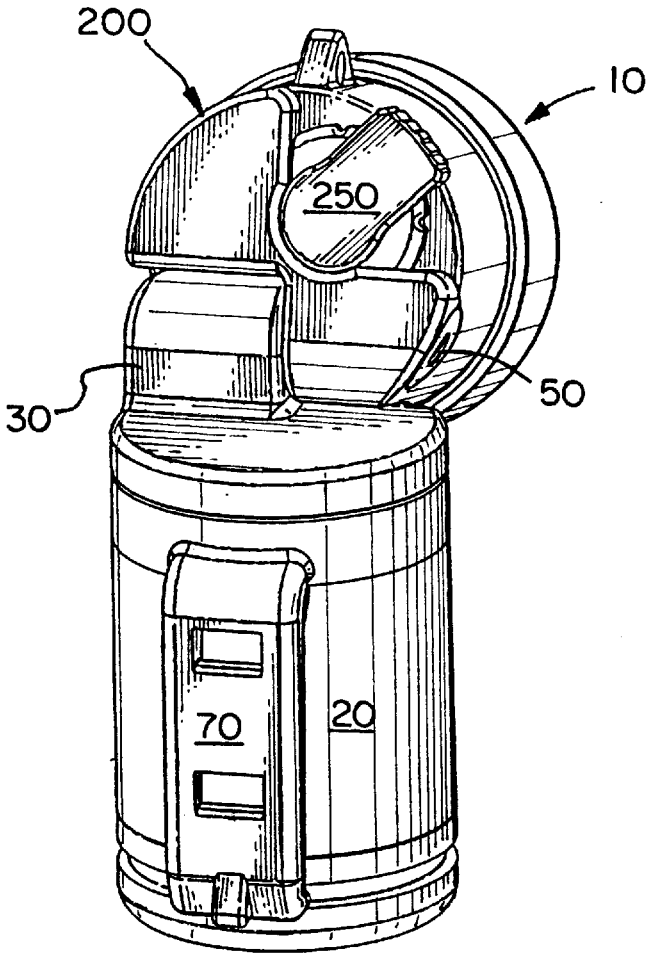
FIG. 22 is a perspective view of the flashlight shown in FIG. 1 with the mounting saddle removed and the lamp head in a rotated position.

Referring now to FIGS. 19–21, a battery charger 400 for recharging the battery back 100 in the flashlight 10 is shown. The battery charger 400 includes a housing 410 having a receptacle 415 extending from the top surface of the housing for receiving the contact-end of the flashlight. Alternatively, the socket 415 can be configured so as to receive only the battery pack 100 instead of the entire flashlight 10. A latch 430 is provided to retain the flashlight or battery pack in the socket 415. In the embodiment shown, the latch 430 is configured to cooperate with an annular groove 96 found in the locking ring of the flashlight (see FIG. 2). If the socket 415 is configured to receive the battery pack 100, the latch 430 is preferably designed to cooperate with the retaining rib 104 located on the external surface of the battery case 102, also shown in FIG. 2.

The latch mechanism includes a lever arm 434 pivotally mounted to the wall of receptacle 415 by a pivot pin 439. A latching finger 437 projects from the distal end of the lever arm 434 to engage the annular groove 96 in the locking ring 90 or the locating rib 104 on the battery case 102. A coil spring 432 biases the proximal end of the lever arm 434, thereby urging the latching finger 437 about the pivot pin and into contact with the flashlight or the battery pack.

To recharge the batteries, two terminals in the battery charger are positioned for contacting the heads of the screws 135,136 in the end of the battery pack. The first terminal is a coil spring 424 that contacts the side screw 136. The second contact is a plunger 420 that contacts the center screw 135. The plunger 420 is biased into contact with the center screw 135 by a spring 426.

Power is supplied to the battery charger 400 via a jack 450 that is adapted for connection to a power source. The jack 450 includes two terminals 455 that are mounted to a circuit board 460. The circuit board is mounted within the housing 410 by a plurality of screws or other fasteners, and a protective bottom cover 445 that is fastened to the base by a like plurality of screws or other fasteners. The contact spring 424 and the plunger 420 are also connected to the circuit board, which includes conductive paths interconnecting the spring contact and the plunger to the terminals 455.

To recharge a battery pack 100, the battery pack or the flashlight is inserted into the socket 415 of the battery charger. A power source is then connected to the jack 450 to provide power to the battery charger. Once the battery pack is recharged, the battery pack or flashlight is removed from the socket by pressing latch 430 to withdraw the latch finger 437 from engagement with the battery pack or flashlight.

While particular embodiments of the invention have been herein illustrated and described, it is not intended to limit the invention to such disclosures, but changes and modifications may be made therein and thereto within the scope of the following claims.

We claim:

1. A flashlight comprising:

a housing;

a battery located within said housing;

a lamp head connected to said housing, comprising:

first and second reflective surfaces;

an incandescent lightbulb projecting from said first reflective surface; and a light-emitting diode projecting from said second reflective surface;

a conductive element providing an electrical path connecting said battery to said lightbulb and said light-emitting diode; and a switch operable to control operation of the incandescent light independently of the light-emitting diode.

2. The flashlight of claim 1 wherein said light-emitting diode emits non-white light.

3. The flashlight of claim 1 wherein the switch is operable between first, second and third positions, wherein in the first position both the incandescent lightbulb and the light-emitting diode are off, in the second position the incandescent lightbulb is on and the light-emitting diode is off, and in the third position the incandescent lightbulb is off and the light emitting diode is on.

* * * * *